US005937971A

United States Patent [19]

Storm

[11] Patent Number: 5,937,971

[45] Date of Patent: Aug. 17, 1999

[54] CONVERTIBLE LIFT MECHANISM

[75] Inventor: George Lawrence Storm, Trotwood, Ohio

[73] Assignee: Vertical Mobility LLC, Dayton, Ohio

[21] Appl. No.: 09/114,367

[22] Filed: Jul. 14, 1998

Related U.S. Application Data

[60] Provisional application No. 60/052,474, Jul. 14, 1997.

[51] Int. Cl.[6] ..... B66B 9/08

[52] U.S. Cl. ..... 187/200; 187/201; 187/245

[58] Field of Search ..... 187/200, 201, 187/245; 414/921, 545

[56] References Cited

U.S. PATENT DOCUMENTS

| | | | |
|---|---|---|---|
| 4,124,097 | 11/1978 | Hawks et al. | 187/200 X |
| 4,168,134 | 9/1979 | Pohl | 414/921 X |
| 4,285,416 | 8/1981 | Dudynskyj | 414/921 X |
| 4,457,402 | 7/1984 | Del Vecchio et al. | 187/200 |
| 4,583,466 | 4/1986 | Reddy et al. | 414/921 X |
| 5,224,723 | 7/1993 | Hatas | 414/921 X |
| 5,234,078 | 8/1993 | Smith | 187/200 |
| 5,632,357 | 5/1997 | Matre | 187/200 |

*Primary Examiner*—Johnny D. Cherry
*Assistant Examiner*—Steven B. McAllister
*Attorney, Agent, or Firm*—Maginot, Addison & Moore

[57] ABSTRACT

A convertible lift mechanism for lifting an object from a first surface to a vertically displaced second surface includes a source of motive force, a conversion stair, and a lift linkage. The convertible lift mechanism may be utilized as a platform lift or a wheelchair lift. The conversion stair has a first configuration and a second configuration. In the first configuration, the conversion stair functions as a stair within a stairway. In the second configuration, the conversion stair has a substantially horizontal lifting surface movable between a first position and a second position. The substantially horizontal lifting surface forms at least a portion of a lift platform.

23 Claims, 6 Drawing Sheets

CONVERTIBLE LIFT MECHANISM

CROSS REFERENCE TO RELATED APPLICATIONS

This application claims the benefit of U.S. Provisional Application No. 60/052,474,filed Jul. 14, 1997.Cross reference is made to my copending U.S. Pat. Application Ser. No. 09/114,774,entitled "Convertible Lift Mechanism Having a Scissor Lift Linkage", which is filed concurrently herewith.

FIELD OF THE INVENTION

The present invention relates generally to the field of vertical lifts, and in particular, lift mechanisms that convert to stairs.

BACKGROUND OF THE INVENTION

Stairways employed in buildings and other structures present difficulties to non-ambulatory individuals. For example, a non-ambulatory individual confined to a personal vehicle such as a wheelchair cannot easily negotiate common stairwells. To accommodate such individuals, separate elevator lifts, moving chair arrangements, or ramps are often provided. In stair structures extending a vertical distance that is less than a building story, such as those typically used near the entrance to a building, a separate elevator lift is not always practical, particularly in outdoor environments. In such cases, separate ramps or moving chair arrangements may be provided which facilitate vertical travel by a personal vehicle.

One drawback to the use of a separate ramp to provide personal vehicle access to elevated surfaces is that suitable ramps consume relatively large amounts of space. As a result, existing buildings must often be substantially altered to accommodate the installation of a ramp. In many circumstances, space constraints surrounding the building make installation of a ramp impossible.

Moving chair arrangements offer a solution in such low rise environments. Moving chair arrangements comprise a chair that slides diagonally up and down the stairway. Such arrangements require that the personal vehicle be separately transported up or down the stairway. Because personal vehicles can be quite heavy, separate transport of the personal vehicle can be difficult. Moreover, the movable chair itself, when not in use, nevertheless occupies stairway space and dictates the appearance of the staircase.

Separate vertical wheelchair lifts have also been employed for such low rise environments for use in situations in which there is inadequate room for an access ramp. Such devices, however, while consuming less space than a ramp, nevertheless consume valuable access space and dictate certain architectural parameters. Moreover, separate wheelchair lifts may be impossible to implement in hallways or other narrow environments.

In an attempt to address some of the concerns of the separate vertical lift, lifts have been developed that cooperate with a staircase to provide a lift that fits within a hallway or narrow environment. For example, U.S. Pat. No. 4,457,402 to Del Vecchio et al. shows a lift that is disposed directly in front of a low rise staircase that extends from a lower surface to an upper surface. The lift provides vertical transport of wheelchairs from the lower surface to the level of the upper surface. When the lift rises, the stairs collapse upward to form a bridge platform that allows travel from the lift platform over the area normally occupied by the staircase to the destination upper surface.

Another proposed design of a lift that may be located in a narrow environment is found in U.S. Pat. No. 5,234,078 to Smith. In the Smith patent, a lift platform is located on the upper surface directly behind the ascending stairs. In other words, the lift platform forms a portion of the upper surface. The lift platform provides transport between the upper surface and the lower surface through vertical movement. When the lift platform lowers to the level of the lower surface, the stairs collapse so that they too are substantially on the level of the lower surface. When the lift platforms rises to the level of the upper surface, the stairs reconfigure into a staircase.

A drawback of the designs found in the Del Vecchio et al. and Smith patents discussed above is that they require space equivalent to the area of the lift platform either completely in front of or completely behind the staircase. In some cases, such area is not available. Moreover, because the lift platform is located completely outside the footprint of the staircase, the lift platform creates a potentially displeasing architectural discontinuity with the surface at which it normally rests while not in operation. For example, as shown in FIG. 1 of the Smith patent, the lift structure requires special wall and floor structures that create visible discontinuities along the floor and wall. Likewise, the lift shown in FIG. 1 of the Del Vecchio et al. patent undesirable creates a plainly visible discontinuity along the intersection of the platform and lower (ground) surface. Such discontinuities significantly affect the appearance of an architectural structure.

There exists a need, therefore, for a lift structure for providing access to personal vehicles between a lower surface and an upper surface that has reduced impact on the architectural and/or design aspects of a structure, and may be employed in structures with space constraints.

SUMMARY OF THE INVENTION

The present invention fulfills the above need, as well as others, by providing a convertible lift mechanism that employs one or more convertible stairs that function as stairs in one configuration and as a lift platform in another configuration. By using stairs that convert into a lift platform, the lift platform need not be implemented as a totally separate structure that both occupies additional space and impinges upon the architectural integrity of a structure. Instead, the convertible lift mechanism of the present invention includes a lift platform that occupies space that is otherwise occupied by the staircase, and therefore requires little or no additional space.

In one embodiment of the present invention, a convertible lift mechanism for lifting a person or an object from a first surface to a vertically displaced second surface includes a source of motive force, a conversion stair, and a lift linkage. The conversion stair has a first configuration and a second configuration. In the first configuration, the conversion stair is substantially stationary and has a substantially horizontal surface that is horizontally positioned apart from the second surface and vertically positioned between the first surface and the second surface. In the second configuration, the conversion stair has a substantially horizontal lifting surface movable between a first position and a second position. The first position is defined by a first horizontal position and a first vertical level, the first vertical level being approximately level with the first surface. The second position is defined by the first horizontal position and a second vertical level, the second vertical level being approximately level with the second surface. The lift linkage is operably coupled to the source of motive force and the conversion stair to cause the conversion stair to move between the first position and the second position responsive to motive force generated by the source of motive force.

The above features and advantages, as well as others, will become more readily apparent to those of ordinary skill in the art by reference to the following detailed description and accompanying drawings.

DETAILED DESCRIPTION

Figure 1:
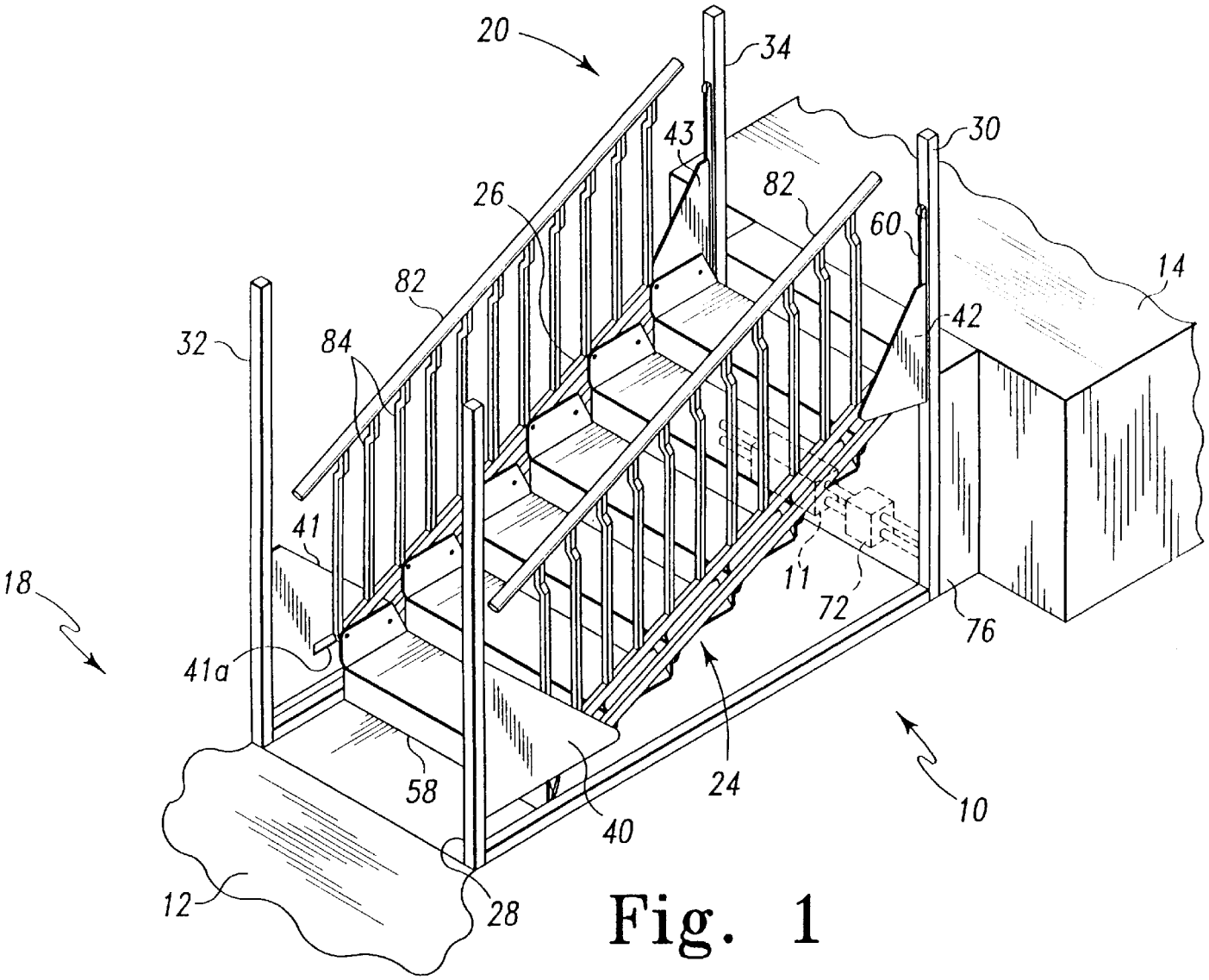
FIG. 1 shows a front right perspective view of an exemplary first embodiment of a convertible lift mechanism according to the present invention in a first configuration to function as a stairway.
Figure 2:
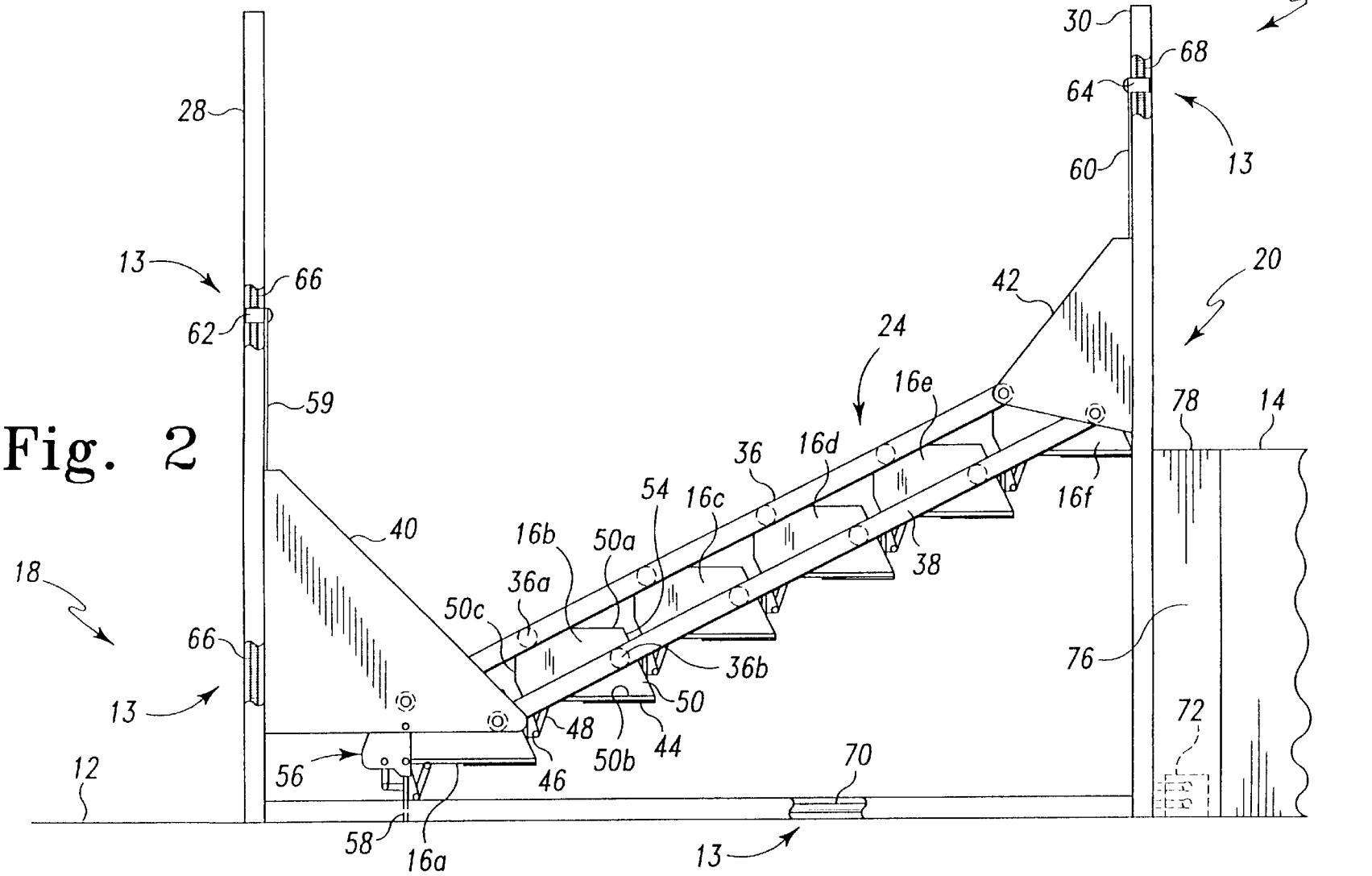
FIG. 2 shows a partial cutaway right plan view of a convertible stair according to the present invention of FIG. 1.

FIGS. 1 and 2 show an exemplary first embodiment of the convertible lift mechanism 10 of the present invention disposed in a low rise environment consisting of a first or lower surface 12 and a second or upper surface 14. FIG. 1 shows a perspective view of the convertible lift mechanism 10 and FIG. 2 shows a side view of the convertible lift mechanism 10 of FIG. 1 in partial cutaway form to expose some of the internal features and structures. In addition, the handrail and associated posts shown in FIGS. 1, 4, 5, and 6 have been removed from the convertible lift mechanism 10 in FIG. 2 for clarity of exposition.

Figure 4:
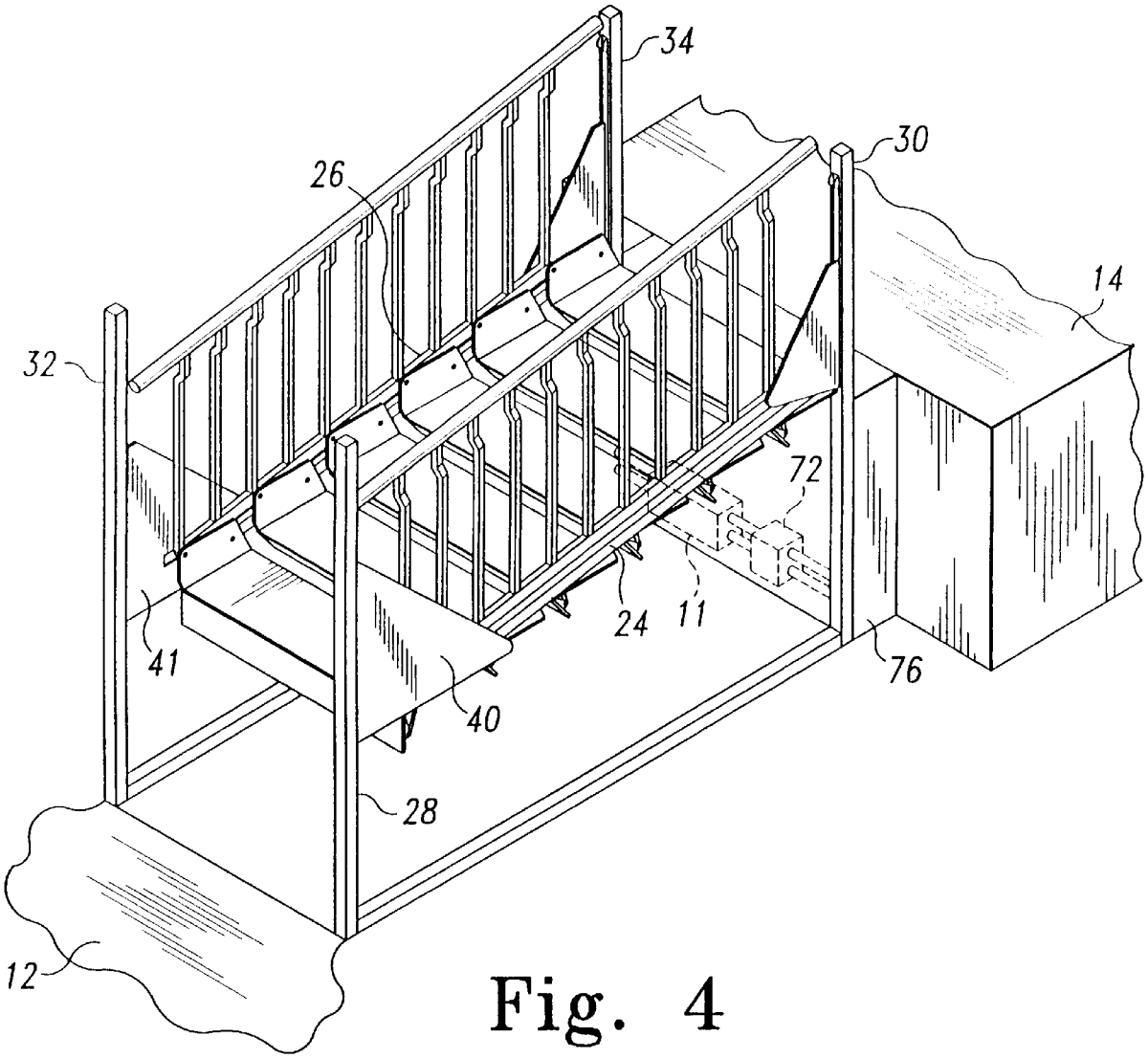
FIG. 4 shows a front right perspective view of the convertible lift mechanism of FIG. 1 during conversion from the first configuration to the second configuration as a vertical lift.
Figure 5:
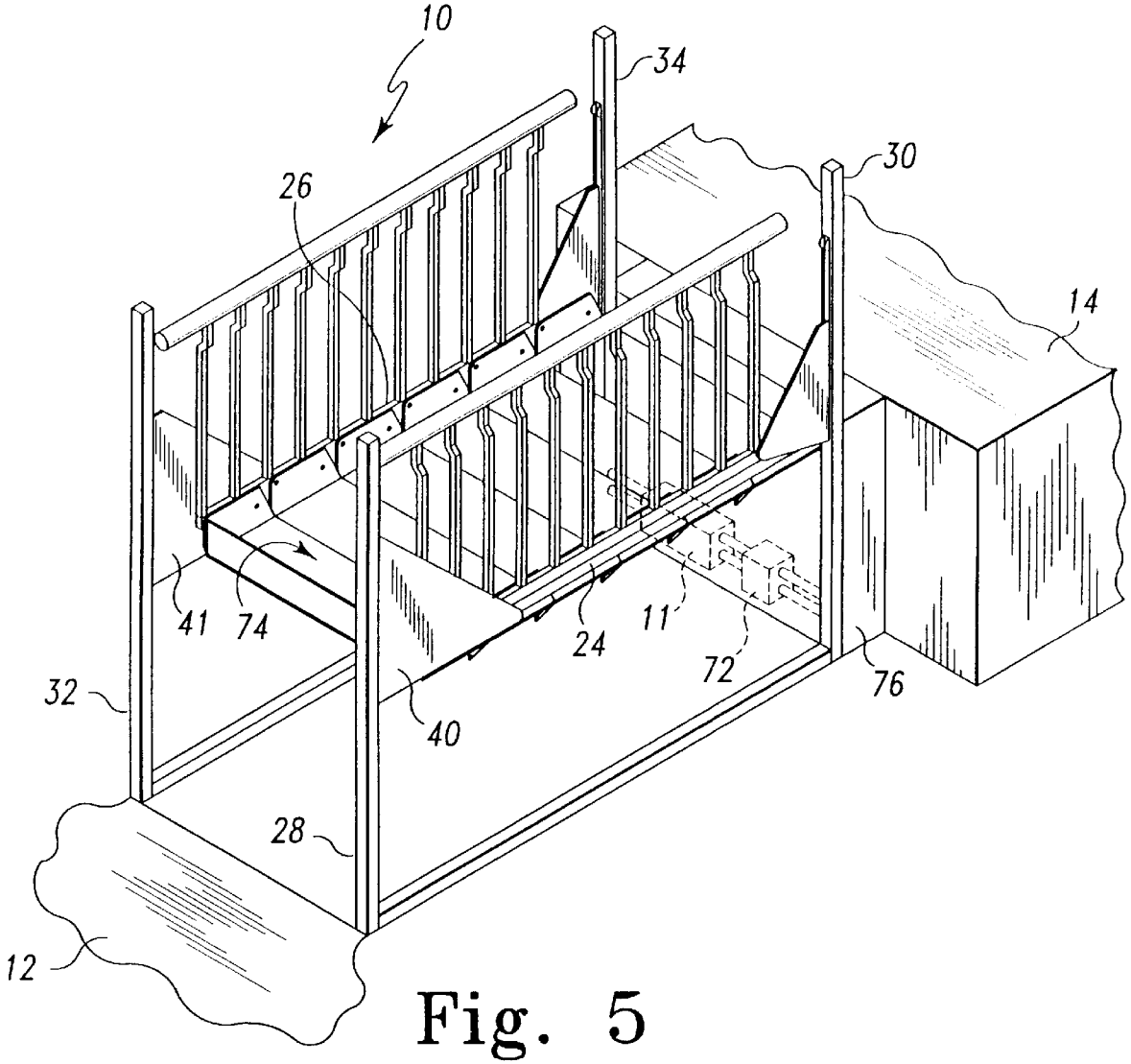
FIG. 5 shows a front right perspective view of the convertible lift mechanism of FIG. 1 in the second configuration as a vertical lift in an upper position.
Figure 6:
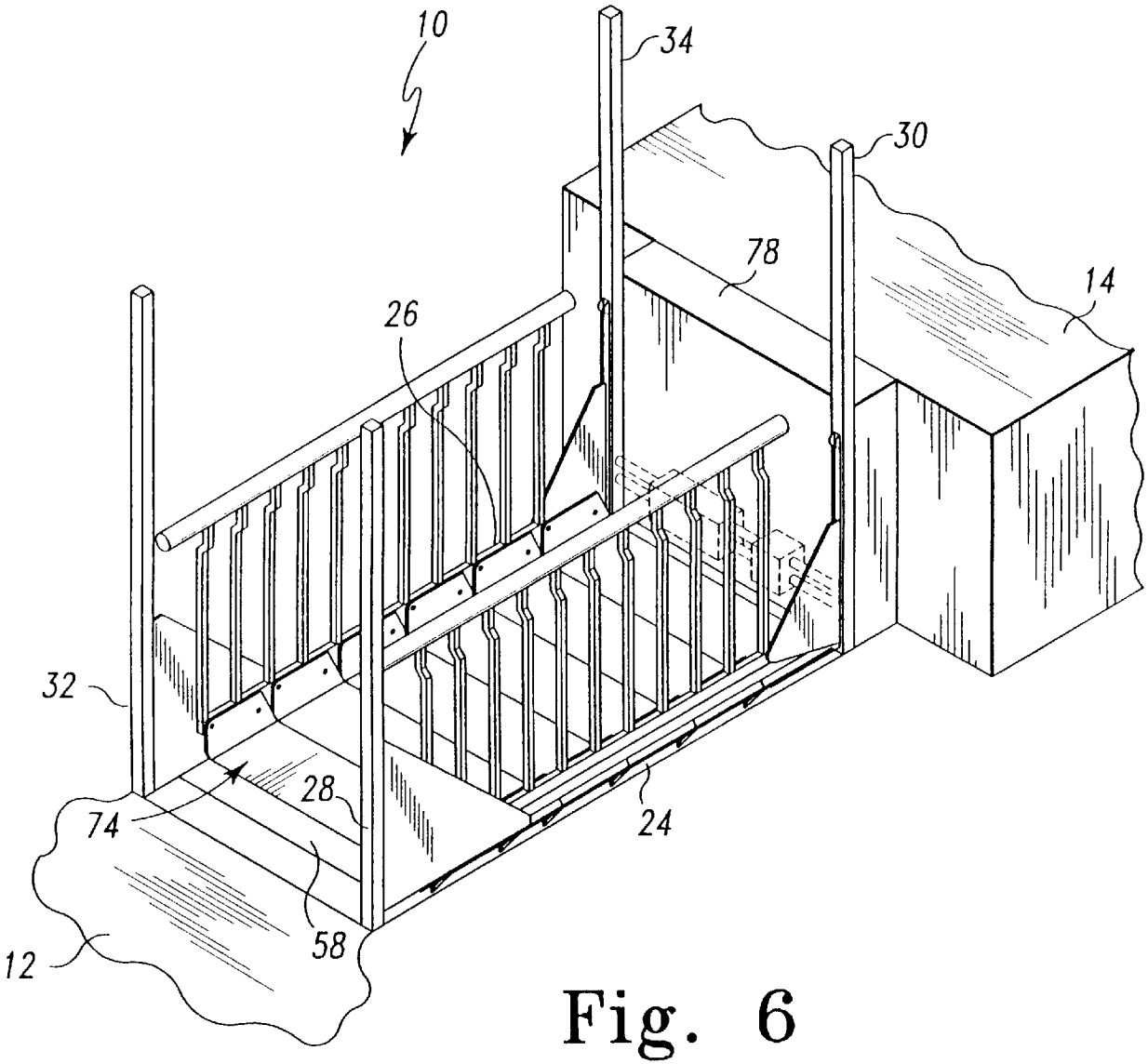
FIG. 6 shows a front right perspective view of the convertible lift mechanism of FIG. 1 in the second configuration as a vertical lift in a lower position.

It is noted that FIGS. 1 and 2 show the first embodiment of the convertible lift mechanism 10 in a first configuration in which it functions as a stairway. As discussed further below, FIGS. 5 and 6 show the convertible lift mechanism 10 in the second configuration in which it functions as a vertical lift, and FIG. 4 shows the convertible lift mechanism 10 during conversion between the first configuration and the second configuration.

Referring to FIGS. 1 and 2, the convertible lift mechanism 10 includes a source of motive force in the form of a motor 11, a lift linkage 13, and a plurality of convertible stairs 16*a*, 16*b*, 16*c*, 16*d*, 16*e*, and 16*f*. In general, the convertible lift mechanism 10 in the first configuration (shown in FIG. 1) forms a staircase and includes a first end 18 proximate the bottom of the staircase and a second end 20 proximate the top of the staircase.

In general, each of the conversion stairs 16*a*, 16*b*, . . . 16*f* has a first configuration that corresponds to the first configuration of the convertible lift mechanism 10. In the first configuration, each of the conversion stairs 16*a*, 16*b*, . . . 16*f* functions as a stair. Similarly, each of the conversion stairs 16*a*, 16*b*, . . . 16*f* has a second configuration that corresponds to the second configuration of the convertible lift mechanism 10. As discussed in further detail below in connection with FIGS. 5 and 6, each of the conversion stairs 16*a*, 16*b*, . . . 16*f* in the second configuration functions as a part of a lift platform.

Referring to FIG. 1, each of the conversion stairs 16*a*, 16*b*, . . . 16*f* functions as a stair in the sense that each is substantially stationary when in the first configuration. Moreover, as any stair within a staircase, the each of the conversion stairs 16*a*, 16*b*, . . . 16*f* includes a substantially horizontal surface (e.g. step plate 44, discussed further below) that has a horizontal position that is displaced from the upper surface 14 and is vertically positioned between the lower surface 12 and the upper surface 14. In addition, all of the conversion stairs 16*a*, 16*b*, . . . 16*f* in the first configuration are displaced from each other both vertically and horizontally in ascending fashion as is typical of stairs in a staircase.

In the exemplary embodiment described herein, the convertible lift mechanism 10 further includes a first parallel linkage 24, a second parallel linkage 26, a first corner post 28, a second corner post 30, a third corner post 32, and a fourth corner post 34. The first parallel linkage 24 comprises an upper linkage 36 and a lower linkage 38. The upper linkage 36 and the lower linkage 38 comprise elongated, rigid, structural members that extend in a parallel manner diagonally upward from proximate the first end 18 to the proximate the second end 20. The upper linkage 36 and lower linkage 38 are each pivotally coupled at one end to the first conversion stair 16*a* and are each further pivotally coupled at the other end to an upper linkage plate 42. The pivotal connections between the upper linkage 36, the lower linkage 38, the first conversion stair 16*a*, and the upper linkage plate 42 form a four bar linkage system as is known in the art. The upper linkage 36 and lower linkage 38 are further pivotally coupled to each of the other conversion stairs 16*b*, 16*c*, 16*d*, 16*e*, and 16*f*.

The second parallel linkage 26 has a construction analogous to that of the first parallel linkage 24, and is connected to the first conversion stair 16*a* and an upper linkage plate 43 in an analogous manner. Accordingly, the second parallel linkage 26 likewise cooperates with the first conversion stair 16*a* and the upper linkage plate 43 to form a four bar linkage system. For reasons that will be discussed below, the first conversion stair 16*a* is also slidably coupled on one side to a lower linkage plate 41 and on the other side to a lower linkage plate 43.

Figure 3:
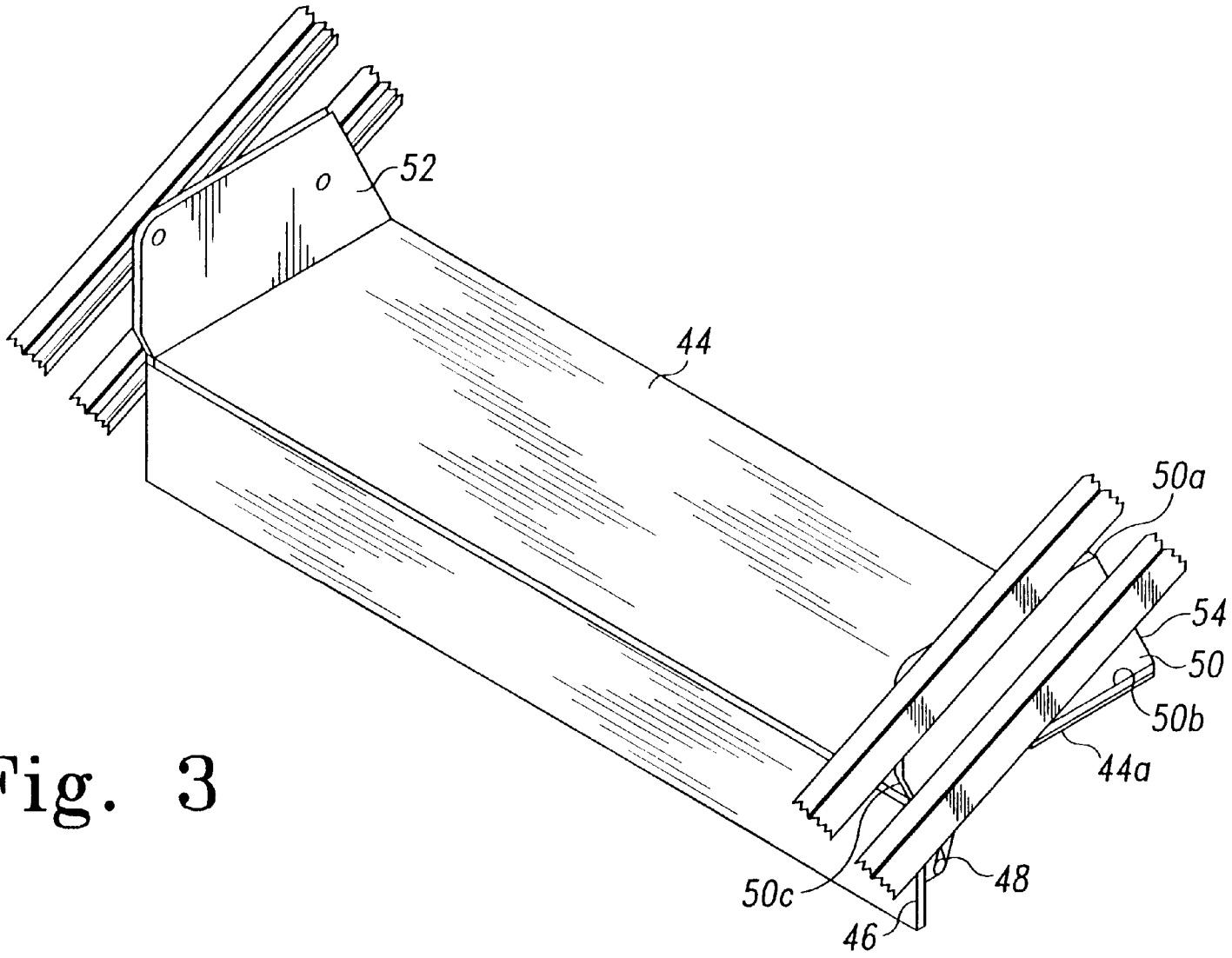
FIG. 3 shows a perspective view of a convertible stair for use in the convertible lift mechanism of FIG. 1.

Referring to FIGS. 1, 2, and 3, the conversion stair 16*b*, which is exemplary of most of the conversion stairs 16*c*, 16*d*, . . . 16*f*, includes a substantially horizontal surface in the form of a step plate 44, a retractable riser 46, a riser linkage 48, a first vertical side plate 50 and a second vertical side plate 52. The first conversion stair 16*a*, which differs in structure from the conversion stairs 16*b*, 16*c*, . . . 16*h* in some aspects, is discussed further below.

Referring to the conversion stair 16*b*, the step plate 44 comprises a substantially horizontal surface for bearing the weight of ambulatory individuals ascending or descending the staircase. The first vertical side plate 50 is generally planar and extends vertically upward from one side edge 44*a* of the step plate 44. The first vertical side plate 50 has a shape defined by two flat horizontal edges 50*a* and 50*b*, and a forward edge 50*c* and a back edge 54. The bottom horizontal edge 50*b* extends the length of the side edge 44*a* of the step plate 44. Preferably, the back edge 54 is inclined to accommodate the adjacent convertible stair 16*c* during conversion from the first configuration to the second configuration.

The first vertical side plate 50 includes a first pivotal connection 36*a* to the upper linkage 36 near its forward edge 50*c* and upper horizontal edge 50*a*, and a second pivotal connection 36*b* to the lower linkage 38 near the middle of the inclined back edge 54. The second vertical end plate 52 has a structure that is substantially the mirror image of the first vertical end plate 50 and is coupled to the second parallel linkage 26 in an analogous manner.

In the embodiment described herein, the retractable riser 46 includes a planar surface that co-extends with, and is pivotally coupled near, the front edge of the step plate 44. The retractable riser 46 is further pivotally coupled to the riser linkage 48. The pivotal coupling between the riser linkage 48 and the retractable riser 46 is advantageously vertically displaced from the pivotal coupling between the retractable riser 46 and the step plate 44. The riser linkage 48 extends vertically upward from (and preferably horizontally backward from) the retractable riser 44 and is further pivotally coupled to the first parallel linkage 24, and preferably, the lower linkage 38.

Each of the conversion stairs 16*c*, 16*d*, . . . 16*f* has a structure similar to that of the conversion stair 16*b*, described above. Accordingly, each of the conversion stairs 16*b*, 16*c*. . . 16*f* is also pivotally coupled to both of the first and second parallel linkages 24 and 26, respectively, an analogous manner.

It is noted that while the convertible stair 16*a* has substantially the same structure as the convertible stair 16*b*, the convertible stair 1 6*a*, which is located most near the first end 18, does not include an analogous retractable riser. Instead, the convertible stair 16*a*includes a convertible riser assembly 56 that includes a plate 58 that functions as a riser when the convertible lift 10 is in the first configuration, and the either a ramp or a safety guard when the convertible lift is in the second configuration, as shown in FIGS. 5 and 6. To this end, a manual linkage may be provided to convert the convertible riser 56 between the three functions. Alternatively, an automated linkage may be provided that causes the plate 58 to be positioned appropriately for each of its three functions based on the movement of the lift linkage 13. Those of ordinary skill in the art may readily devise their own implementation of a convertible riser that suits their particular implementation. An example of a convertible riser assembly that may be used in the embodiment described herein with minor modification is described in copending, U.S. Pat. application Ser. No. 09/114,774, which is assigned to the assignee of the present invention and incorporated herein by reference.

In the exemplary embodiment described herein, the first conversion stair 16*a* is also slidably coupled to the lower linkage plate 40 to permit the first conversion stair 16*a*to travel horizontally along at least a portion of the length of the lower linkage plate 40. To this end, the lower linkage plate 40 includes a track, not shown, that receives the pivotal connection between the first conversion stair 16*a* and the lower linkage 38. (see analogous track 41*a* on the lower linkage plate 41 in FIG. 1) The lower linkage plate 40 is further secured to a lift bar 59. The lift bar 59 is operably coupled to the lift linkage 13 to move in a vertical manner responsive to motion of the lift linkage 13. The upper linkage plate 42 is similarly secured to a lift bar 60. Like the lift bar 58, the lift bar 60 is operably coupled to the lift linkage 13 to move in a vertical manner responsive to motion of the lift linkage 13.

More particularly, in the exemplary embodiment described herein, the lift linkage 13 includes a first forward lead screw 66 vertically disposed within the first corner post 28, a first rear lead screw 68 vertically disposed within the second corner post 30, a second forward lead screw, not shown, vertically disposed within the third corner post 32, and a second rear lead screw, not shown, vertically disposed within the fourth corner post 34. The lift bar 59 connects to the first forward lead screw 66 through a nut drive 62 such that rotation of the first forward lead screw 66 causes vertical displacement of the lift bar 59. Similarly, the lift bar 60 connects to the first rear lead screw 68 through a nut drive 64 such that rotation of the first rear lead screw 68 causes vertical displacement of the lift bar 60.

It will be appreciated that the lower linkage plate 41 and the upper linkage plate 43 are similarly coupled to the second forward lead screw and second rear lead screw, respectively, by corresponding lift bars and lift nuts, not shown.

The motor 11 is operably connected to the first rear lead screw 68 and the second rear lead screw through the clutch 72 as well as through suitable gears and shafts, the arrangement of which would be known to those of ordinary skill in the art. To this end, it is noted that the motor 11 and the clutch 72 shown in FIG. 1 are confined within a drive housing 76. The drive housing 76 is preferably located underneath an integrated false top step 78. The false top step 78 is fixedly supported from the ground and finctions as an extension of the upper surface 14. The false top step 78 creates an opening in which the drive housing 76 may be stowed.

It is noted that with such a false step arrangement, the convertible lift mechanism 10 may be completely installed at or above the lower surface 12, thereby allowing the motor 11 and clutch to be hidden from view without excavating below the lower surface 12 or upper surface 14. However, many of the advantages of reducing space consumption provided by the present invention may be realized even if the false top step 78 is eliminated and the motor 11 and the clutch 72 are either exposed, or installed under the surface of either the upper surface 14 or lower surface 12.

In any event, the first forward lead screw 66 is coupled through a gear, not shown, to a first horizontal shaft 70 that extends from the first end 18 to the second end 20 and is preferably disposed at a vertical level at or slightly above the lower surface 12. The second forward lead screw is similarly coupled to a similarly disposed second horizontal shaft, not shown. The motor 11 is operably coupled to the first horizontal shaft 70 and the second horizontal shafts through suitable means to impart rotational motion thereto. Such means may include gear and shaft arrangements, belt or chain drives, or a combination thereof. The details of such arrangements is a matter of design choice and would be known to those of ordinary skill in the art.

The clutch 13 is controllable such that rotational motion of the motor 11 may be selectively applied to the first rear lead screw 68 and the second rear lead screw. As discussed further below, such selective application of the rotational motion of the motor 11 facilitates the conversion of the convertible lift mechanism 10 from the first configuration (stairway) to the second configuration (vertical lift), and vice versa.

In operation, the convertible lift mechanism 10 typically remains in the first configuration to provide a passive staircase between the lower surface 12 and the upper surface 14. In general, if a non-ambulatory person desires transport between the lower surface 12 and the upper surface 14, the convertible lift mechanism 10 converts to the second configuration. In the second configuration, the convertible stairs 16*a*, 16*b*, . . . 16*f* form a substantially horizontal lifting surface movable between the lower surface 12 and the upper surface 14.

In particular, the conversion stairs 16*a*, 16*b*, 16*c*, 16*d*, 16*e*, and 16*f* in the second configuration are operable to move such that their substantially horizontal lifting surfaces between a first position and a second position, the first position being approximately level with the lower surface 12 and the second position being approximately level with the upper surface 14. By "approximately level" it is meant that one surface is within one or two inches from another surface. In any event the first position and the second position are furthermore aligned vertically, or in other words, one position is above the other.

It is noted that two handrails 82 are also provided. Each of the handrails 82 is pivotally coupled to a plurality of handrail posts 84. Each of the plurality of handrail posts 84 is pivotally coupled to either the first parallel linkage 24 or the second parallel linkage 26.

To convert from the first configuration to the second configuration, the convertible lift mechanism 10 operates as described below. A control, not shown, is activated indicating that a request has been made for conversion from the first configuration to the second configuration. For example, a person in a wheelchair may have approached the convertible lift mechanism 10 on the lower surface 12 and depressed a button, not shown, that signals a request for a vertical lift.

Responsive to such a signal, a control circuit, not shown, controls the operation of the motor 11 and clutch 72 to perform the conversion process as discussed below. Such a control circuit may suitably be microprocessor-based. The detailed structure and operation of such control circuitry is outside the scope of the present invention and would be known to those of ordinary skill in the art.

Initially, the clutch 72 disengages the motor 11 from the first rear lead screw 68 and the second rear lead screw. The motor 11 then begins to rotate in a first rotational direction. Rotation of the motor is translated through the first horizontal shaft 70 to the first forward lead screw 66, as well as through the second horizontal shaft to the second forward lead screw. Rotation of the first forward lead screw 66 and the second forward lead screw cause, respectively, the lower plates 40 and 41 to move vertically upward. Because the clutch 72 is disengaged, the upper plates 42 and 43 remain stationary.

As the lower plates 40 and 41 move vertically upward while the upper plates 42 and 43 remain stationary, each of the first parallel linkage 24 and the second parallel linkage 26 pivots upward in a manner dictated by their respective four bar linkage configurations.

In particular, for example, the upward movement of the lower plate 40 forces the pivotal connection 39 between the lower linkage 38 and the first convertible stair 16*a* upward. The pivotal connection 39 slides forward on the track of the lower plate 40 to accommodate the horizontal displacement caused by the pivotal motion of the lower linkage 38. The pivotal connections between the convertible stairs 16*a*, 16*b*, . . . 16*f*, the upper linkage 36, and the lower linkage 38 cause the upper linkage 36 to also move in a pivotal motion upward. However, because the pivotal connection between the upper linkage 36 and the upper plate 42 is fixedly offset from the pivotal connection between the lower linkage 38 and the upper plate 42, the displacement between the upper linkage 36 and the lower linkage 38 decreases as each pivot upwards. Such action is characteristic of four bar linkage arrangements.

FIG. 4 shows the convertible lift mechanism 10 of FIGS. 1 and 2 in transition between its first and second configurations. Referring to FIGS. 1, 2, and 4, the pivotal upward movement of the first parallel linkage 24 and the second parallel linkage 26 causes the convertible stairs 16*a*, 16*b*, 16*c*, 16*d*, and 16*e* to move upward in an arcuate path. Because of the dual pivotal connections between the convertible stairs 16*a*, 16*b*. . . 16*e* and each of the parallel linkages 24 and 26, the convertible stairs 16*a*, 16*b*. . . 16*e* substantially maintain their original orientation. In other words, their step plates remain in a substantially horizontal orientation during conversion from the first configuration to the second configuration.

The motor 11 turns off when the first parallel linkage 24 and second parallel linkage 26 are oriented substantially horizontally, and generally at the level of the highest convertible stair 16*h*. To this end, limit switches may be used to provide feedback information to controls for the motor 11 to cause the motor to turn off. Alternatively, precise control of a stepper motor without feedback may be used. In either event, once the motor 11 turns off, the convertible lift mechanism 10 is in the second configuration. In the second configuration, the step plate 44 of the convertible stair 16*b* and the corresponding step plates of the other convertible stairs 16*a*, 16*c*, 16*d*, . . . 16*f* operate as horizontal lift surfaces. The horizontal lift surfaces of the convertible stairs 16*a*, 16*b*, . . . 16*f* cooperate to form a personal vehicle lift surface 74.

As shown in FIG. 4, after the motor 11 stops, the personal vehicle lift surface 74 is substantially level with the highest conversion stair 16*f*. Accordingly, the lift surface 74 must then be lowered to the first position (adjacent the lower surface 12) or raised to the second position (adjacent the upper surface 14) to allow boarding by a passenger.

In the exemplary operation described herein, it is assumed that the prospective passenger of the convertible lift mechanism 10 is initially located on the lower surface 12. Accordingly, the convertible lift mechanism 10 lowers the personal vehicle lift surface 74 to the lower surface 12. To this end, the clutch 72 engages the motor 11 to the first rear lead screw 68 and the second rear lead screw. Once engaged, the motor 11 begins to operate, rotating in a second rotational direction.

Rotation of the motor is translated through the first horizontal shaft 70 to the first forward lead screw 66, through the second horizontal shaft to the second forward lead screw, and through the clutch 74 to each of the first rear lead screw 68 and the second rear lead screw. Rotation of the first forward lead screw 66 and the second forward lead screw cause, respectively, the lower plates 40 and 41 to move vertically downward. Likewise, rotation of the first rear lead screw 68 and the second rear lead screw cause the upper plates 42 and 43 respectively, to move vertically downward. The plates 40, 41, 42 and 43 all move substantially uniformly.

As the plates 40, 41, 42 and 43 move vertically downward, the personal vehicle lift platform 74 formed by the horizontal lift surfaces of the convertible stairs 16*a*, 16*b*, . . 16*f* moves vertically downward. When the personal vehicle lift platform 74 reaches its first position, or in other words, a position in which it is approximately level with the lower surface 12, the motor 11 stops. Again, limit switches, some other feedback mechanism, or precise motor control causes the motor 11 to stop when the personal vehicle lift platform 74 is approximately level with the lower surface 12.

It will be appreciated that the personal vehicle lift platform 74 typically rests on a portion of the lower surface 12. Accordingly, the surface of the personal vehicle lift platform 74 will be slightly higher than the lower surface 12. However, in alternative embodiments, the portions of the lower surface 12 below the convertible lift mechanism 10 could be removed or excavated to facilitate vertical alignment of the personal vehicle lift platform 74 to the lower surface 12. In either event the surface of the personal vehicle lift platform 74 is considered to be "approximately" level with the lower surface 12.

Because the lift platform 74 is typically slightly vertically displaced from the lower surface 12 a small ramp is desirable to provide a smooth transition from the lower surface 12 to the lift platform 74. To this end, the convertible riser assembly 56 causes the plate 58 to extend substantially horizontally outward to form a ramp, as shown in FIG. 6.

After the lift platform 74 is properly positioned in the first position, the passenger may board the lift platform 74. Then, through actuation of a mechanism such as a push button, not shown, the convertible lift mechanism 10 elevates the lift platform 74 to the upper surface 14 by performing the inverse of the operations described above in connection with lowering the lift platform 74. In addition, the convertible riser assembly 56 preferably causes the plate 58 to rotate upward to function as a safety guard.

Once the lift platform 74 reaches the second position, or in other words, is approximately level with the upper surface 14, the passenger may alight from the lift platform 74. After the passenger has safely alighted from the lift platform 74, the convertible lift mechanism 10 then converts back to the first configuration. To this end, the lift platform 74 is lowered until the convertible stair 16*f* is in its original vertical position. Thereafter, the clutch 72 disengages the motor 11 from the first rear lead screw 68 and the second rear lead screw and then rotates in the second direction. The rotation of the motor 11 causes rotation of the first forward lead screw 66 and the second forward lead screw, thereby causing the lift bars 60 and 61 to descend vertically.

As the lift bars 60 and 61 descend vertically, the first parallel linkage 24 and the second parallel linkage 26 return to their original, inclined position as shown in FIGS. 1 and 2. As a result, through action substantially opposite that described above in connection with the conversion from the first configuration to the second configuration, the conversion stairs 16*a*, 16*b*. . . 16*f* slowly revert to their original configuration as stairs. Once the conversion stair 16*a* reaches its original position in the first configuration, the motor 11 stops rotating. At some point during the conversion, the plate 58 of the convertible riser assembly 56 rotates such that it extends vertically down from the step plate 44, thereby forming a riser for the convertible stair 16*a*.

Accordingly, the present invention provides an improved method and apparatus for lifting a person or an object, such as a personal vehicle, from a lower surface to an upper surface in a low-rise environment. As discussed above, prior art solutions required a substantial amount of additional space to provide facilities for non-ambulatory persons. Not only were the additional space requirements difficult and some times impossible to accommodate at all, even when accommodation was possible, the prior art devices often required alteration of the architectural structure of a facility. By contrast, the method and apparatus of the present invention employs the same footprint for both the stairs and the alternative facilities by converting one or more stairs to a lift platform. The resulting structure has the advantage of requiring substantially less space.

Another advantage of the embodiment described herein is that each end of the platform 74 is supported by two vertical supports. In particular, the first end of the lift platform 74 (adjacent the first end 18) is supported by the first corner post 28 and the third corner post 32 and the opposite end of the lift platform is directly supported by the second corner post 30 and the fourth corner post 34. Such support provides structural strength and integrity that surpasses designs in which one end is indirectly supported in a cantilevered arrangement. Cantilevered support arrangements are more prone to failure and require stronger structural members.

It will be noted that the above described embodiments are merely illustrative. Those of ordinary skill in the art may readily devise their own implementations that incorporate the principles of the present invention and fall within the spirit and scope thereof. For example, as described in my copending patent application, Ser. No. 09/114,774 filed Jul. 13, 1998, other types of lift linkages may be employed to move a platform formed by surfaces of one or more convertible stairs in a vertical path. Moreover, while the source of motive power in the above described embodiment is an electric motor, other forms of motive power may be employed, such as a hydraulic lift system power source, a pneumatic piston system power source, and the like. Those of ordinary skill in the art may readily determine the appropriate type of motive power source, and the appropriated linkage configurations, for their particular implementation.

I claim:

1. A convertible lift mechanism for lifting a person or an object from a first surface to a vertically displaced second surface, the convertible lift mechanism comprising:

a) a source of motive force;

b) a conversion stair having a first configuration and a second configuration, the conversion stair being substantially stationary and having a substantially horizontal surface that is horizontally positioned apart from the second surface and vertically positioned between the first surface and the second surface when the conversion stair is in the first configuration, the conversion stair having a substantially horizontal lifting surface movable between a first position and a second position when the conversion stair is in the second configuration, the first position defined by a first horizontal position and a first vertical level, the first vertical level being approximately level with the first surface, the second position defined by the first horizontal position and a second vertical level, the second vertical level being approximately level with the second surface; and c) a lift linkage operably coupled to the source of motive force and the conversion stair to cause the conversion stair to move between the first position and the second position responsive to motive force generated by the source of motive force;

d) a first parallel linkage coupling the conversion stair to the lift linkage, the first parallel linkage pivotally coupled to first and second pivot points of the conversion stair; and e) a retractable riser pivotally coupled to the conversion stair, the retractable riser being retracted when the conversion stair is in the second configuration.

2. The convertible lift mechanism of claim 1 further comprising a plurality of convertible stairs, each having a first configuration and a second configuration, each conversion stair having a substantially horizontal surface positioned vertically between the first surface and the second surface and being horizontally positioned apart from the second surface when in the first configuration, each conversion stair having a substantially horizontal lifting surface movable between a stair first position and a stair second position when in the second configuration, each stair first position defined by a stair horizontal position and the first vertical level, and stair second position defined by the stair horizontal position and the second vertical level.

3. The convertible lift mechanism of claim 2 wherein the conversion stair and the plurality of conversion stairs are configured to form a staircase when each conversion stair is in the first configuration.

4. The convertible lift mechanism of claim 3 wherein the lift linkage includes a parallel linkage pivotally coupled to first and second pivot points of each conversion stair.

5. The convertible lift mechanism of claim 4 wherein the parallel linkage is configured to move pivotally to convert each conversion stair from the first configuration to the second configuration, and wherein the each substantially horizontal lift surface of each convertible stair in the second configuration cooperates to define a lift platform.

6. The convertible lift mechanism of claim 5 wherein the parallel linkage is further configured to move substantially uniformly vertically from a first linkage level corresponding to the first vertical level and a second linkage level corresponding to the second vertical level.

7. The convertible lift mechanism of claim 1 wherein the parallel linkage is configured to move pivotally to convert the convertible stair from the first configuration to the second configuration.

8. The convertible lift mechanism of claim 7 wherein the parallel linkage is further configured to move uniformly vertically between a first linkage level corresponding to the first vertical level and a second linkage level corresponding to the second vertical level.

9. The convertible lift mechanism of claim 8 wherein the parallel linkage is pivotally coupled to a device disposed proximate the second surface.

10. The convertible lift mechanism of claim 1 wherein the horizontal lifting surface forms at least a portion of a lift platform having a first end and an opposing second end, the second end being horizontally adjacent to the second surface, and wherein the lift linkage includes a first vertical support coupled to the platform proximate the first end and a second vertical support coupled to the platform proximate the second end.

11. The convertible lift mechanism of claim 1 wherein the source of motive force, the convertible stair mechanism, and the lift linkage are each disposed at a vertical level that is at or above the level of the first surface.

12. A convertible lift mechanism for lifting a personal vehicle from a first surface to a vertically displaced second surface, the convertible lift mechanism comprising:

a) a source of motive force;

b) a conversion stair having a first configuration and a second configuration, the conversion stair being substantially stationary and having a substantially horizontal surface that is vertically positioned between the first surface and the second surface and that is horizontally positioned apart from the second surface when the conversion stair is in the first configuration, the conversion stair forming at least a portion of a personal vehicle lift platform movable between a first position and a second position when the conversion stair is in the second configuration, the first position defined by a first vertical level that is approximately level with the first surface, and the second position defined by a second vertical level that is approximately level with the second surface, the conversion stair further comprising a first end and an opposing second end, the first end closer than the second end to the second surface;

c) a lift linkage operably coupled to the source of motive force and the conversion stair to cause the conversion stair to move between the first level and the second level responsive to motive force generated by the source of motive force said lift linkage including a first support member extending from a position on the first surface that is closer to the second end of the conversion stair than to the first end of the conversion stair.

13. The convertible lift mechanism of claim 12 further comprising a plurality of convertible stairs, each having a first configuration and a second configuration, each conversion stair having a substantially horizontal surface positioned vertically between the first surface and the second surface and positioned horizontally apart from the second surface when in the first configuration, each conversion stair having a substantially horizontal lifting surface movable between a stair first position and a stair second position when in the second configuration, each stair first position defined in part by the first vertical level, and each stair second position defined in part by the second vertical level.

14. The convertible lift mechanism of claim 13 wherein the conversion stair and the plurality of conversion stairs are configured to form a staircase when each conversion stair is in the first configuration.

15. The convertible lift mechanism of claim 14 wherein the lift linkage includes a first parallel linkage pivotally coupled to first and second pivot points of each conversion stair.

16. The convertible lift mechanism of claim 15 wherein the parallel linkage is configured to move pivotally to convert each conversion stair from the first configuration to the second configuration, and wherein each conversion stair in the second configuration cooperates to define the personal vehicle lift platform.

17. The convertible lift mechanism of claim 16 wherein the parallel linkage is further configured to move uniformly vertically from a first linkage level corresponding to the first vertical level and a second linkage level corresponding to the second vertical level.

18. The convertible lift mechanism of claim 12 wherein the lift linkage includes a parallel linkage pivotally coupled to first and second pivot points of the conversion stair.

19. The convertible lift mechanism of claim 18 wherein the parallel linkage is configured to move pivotally to convert the conversion stair from the first configuration to the second configuration.

20. The convertible lift mechanism of claim 19 wherein the parallel linkage is further configured to move uniformly vertically from a first linkage level corresponding to the first vertical level and a second linkage level corresponding to the second vertical level.

21. The convertible lift mechanism of claim 20 wherein the parallel linkage is pivotally coupled to a device disposed proximate the second surface.

22. A method of moving a person or an object from a first surface to a vertically displaced second surface, the method comprising:

a) converting a conversion stair from a first configuration to a second configuration, said conversion stair in the first configuration being substantially stationary and having a substantially horizontal surface that is horizontally positioned apart from the second surface and vertically positioned between the first surface and the second surface, said conversion stair in the second configuration being movable and having a substantially horizontal lifting surface, the conversion stair having a first end and an opposing second end, the first end closer than the second end to the second surface;

b) employing a lift linkage to move the substantially horizontal lifting surface from a first position to a second position, the first position being defined by a first horizontal position and a first vertical level, the first vertical level being approximately level with the first surface, the second position being defined by the first horizontal position and a second vertical level, the second vertical level being approximately level with the second surface, wherein the lift linkage comprises a first support member extending from a position on said first surface that is closer to the second end of said conversion stair than to the first end of said conversion stair.

23. The method claim of claim 22 wherein step b) further comprises moving the substantially horizontal lifting surface in a substantially vertical direction.

* * * * *